US005614916A

United States Patent [19]

Mizuguchi

[11] Patent Number: 5,614,916

[45] Date of Patent: Mar. 25, 1997

[54] ELLIPTIC BEAM HORN ANTENNA

[75] Inventor: Yoshihiko Mizuguchi, Tama, Japan

[73] Assignee: Kokusai Denshin Denwa Kabushiki Kaisha, Tokyo, Japan

[21] Appl. No.: 492,742

[22] Filed: Jun. 21, 1995

[30] Foreign Application Priority Data

Jun. 29, 1994 [JP] Japan ..... 6-168591

[51] Int. Cl.[6] ..... H01Q 13/00

[52] U.S. Cl. ..... 343/786; 343/781 R; 333/21 A

[58] Field of Search ..... 343/781 R, 786, 343/840; 333/21 A, 239

[56] References Cited

U.S. PATENT DOCUMENTS 3,728,726 4/1973 Howard ..... 340/600

4,196,393 4/1980 Schweitzer ..... 340/600

5,438,340 1/1995 Fukuzawa et al. ..... 343/840

*Primary Examiner*—Donald T. Hajec

*Assistant Examiner*—Tan Ho

*Attorney, Agent, or Firm*—Emmanuel J. Lobato; Burns & Lobato, P.C.

[57] ABSTRACT

An elliptic beam antenna easy to design and simple in structure. To generate elliptic beams of about the same size regardless of the kind of polarized waves for excitation, a horn antenna or waveguide structure intended for radiating out radio waves into space features the provision of diamond aperture, modified from the conventional circular, elliptical, square or rectangular one and excitation of radio waves in diagonal directions.

6 Claims, 4 Drawing Sheets

| APERTURE SHAPE | POLARIZED WAVE | RADIATION PATTERN (CONTOUR LINE) |
|---|---|---|
| | VERTICAL | |
| | HORIZONTAL | |
| | VERTICAL | |
| | HORIZONTAL | |
| | VERTICAL | |
| | HORIZONTAL | |

ELLIPTIC BEAM HORN ANTENNA

BACKGROUND OF THE INVENTION

The present invention relates to an elliptic beam antenna used in various kinds of radar, satellite communications, satellite broadcasting and terrestrial radio communications.

In the fields of radar, satellite communication and satellite broadcasting, antennas of the type radiating elliptic beams are often used with a view to achieving such effects as mentioned below. First, in a case of radar, a beam width in the direction of scanning is made smaller than in a direction crossing it at right angles so as to provide enhanced angular resolution in the direction of scanning. In the direction perpendicularly intersecting that of scanning, a cosecant beam having a slightly raised level at the bottom of the radiation pattern may sometimes be used with a view to compensate for a far-near distance effect.

Second, satellite antennas for satellite communications or satellite broadcasting sometimes employ an elliptic beam rather than a circular one for the purpose of high efficiency coverage of service areas. In a case of earth station antennas, to reduce the amount of interference between adjacent satellites, the minor axis of the elliptic beam is pointed toward the direction of orbit of a geostationary satellite to make the level of the sidelobe in this direction lower than in case of using the circular beam. This scheme, in some cases, omits antenna tracking of the direction off diurnal variations in the position of the satellite by perturbation.

Incidentally, an efficient elliptic beam cannot be generated by an ordinary rectangular, circular or elliptical aperture horn alone. FIG. 7 shows this; as in a case of a square or circular aperture horn, the directions of the major and minor axes of the elliptic beam shift with each other according to the kind of polarized wave for excitation. In case of the elliptic aperture horn, also, the flatness changes with the kind of polarized wave for excitation; that is, the one polarization produces an elliptic beam but the other polarization a circular beam. The irradiation of an elliptical service area or reflecting mirror with such beams will cause an spillover of radio waves, and hence is inefficient in terms of antenna gain, besides degradation of the side lobe characteristic by the spillovering radio waves leads to an increase of interference between the system concerned and other systems.

Since the circularly polarized wave which is used in radar is obtained by synthesizing the above-mentioned horizontally polarized and vertically polarized waves, the excitation by the circularly polarized wave cannot generate an efficient elliptic beam either; furthermore, there are cases where a ghost is formed or resolution is impaired by the side lobe.

That is, the elliptic beam can efficiently be generated only by the combined use of a reflecting mirror with an elliptical aperture and a feeder system which emits the elliptic beam.

Hence, there have been employed various feeder systems, such as listed below, in combination with an elliptical reflector.

(1) Waveguide array or the like (FIG. 8)

(2) Corrugated conical horn and modified sub-reflector (FIG. 9)

(3) Elliptical corrugated horn (FIG. 10)

The combination (1) is used to generate a difference pattern as well as a sum pattern mainly in the field of radar. The combination (2) is used in small earth station antennas and (3) in satellite antennas.

The prior art schemes (1) to (3) cannot attain their objects without making full use of complex and sophisticated design/fabrication technologies. That is, the array such as a waveguide (1) must be designed/manufactured taking into account such conditions as horn size/horn number tradeoffs and the branching (multiplying) accuracy of a feeding circuit. The corrugated horns (2) and (3) are not suited to mass production as compared with ordinary circuit aperture horns and rectangular aperture horns. The elliptical corrugated horn is more difficult to design and fabricate than the conical corrugate horn. Furthermore, it is also necessary to produce a main reflector and a sub-reflector that are needed in (2), by modification from a quadratic surface such as a paraboloid or hyperboloid.

For the reasons given above, conventional antennas are expensive.

SUMMARY OF THE INVENTION

It is an object of the present invention to provide an elliptic beam antenna which is easy to design and simple in structure.

To attain the above object, the antenna unit of the present invention has a construction in which a horn antenna or waveguide structure for radiating out radio waves into space has a diamond or rhombic aperture, modified from the traditional circular, elliptical, square or rectangular one, is adapted to excite radio waves in diagonal directions so as to generate elliptic beams of about the same size.

BRIEF DESCRIPTION OF THE DRAWINGS

The present invention will be described in detail below with reference to the accompanying drawings, in which.

PREFERRED EMBODIMENTS OF THE INVENTION

Figure 1A:
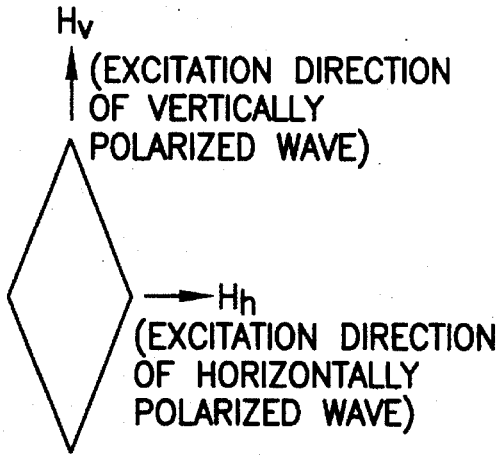
FIG. 1*a* and FIG. 1*b* are diagrams illustrating an aperture configuration in FIG. 1*a* and the radiation pattern FIG. 1*b* according to a first embodiment of the present invention.
Figure 1B:
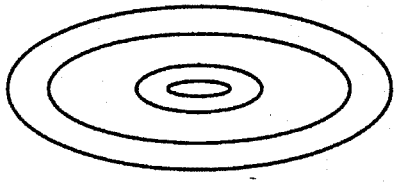

FIGS. 1*a* and 1*b* illustrate a first embodiment of the present invention, which has an aperture shown in FIG. 1*a* essentially in the shape of a diamond a rhombus of a tramp card and excites radio waves so that one or both of two diagonal directions of the diamond coincide with the electric field vector of the radio waves (the direction of polarization). Shown in shown in FIG. 1*b* is a radiation pattern. When a horn with a diamond aperture of a 2 to 1 diagonal ratio and a horn with an elliptical aperture of a 2 to 1 major/minor-axis ratio are excited by both vertically and horizontally polarized waves, the major/minor-axis ratios of the resulting elliptic beams at the half-value width (−3 dB) are 1.64 to 1.84 in a case of the diamond aperture and 2.3 to 1.58 in a case of the elliptical aperture. This indicates that the diamond aperture produces elliptic beams with less polarization dependence than the elliptical aperture.

Figure 2:
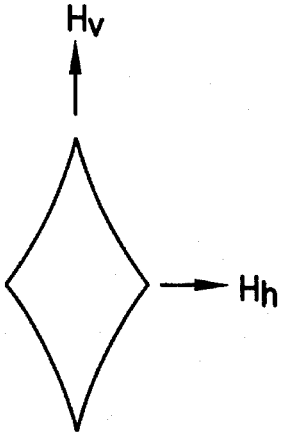
FIG. 2 is a diagram showing an aperture configuration according to a second embodiment of the present invention.
Figure 3:
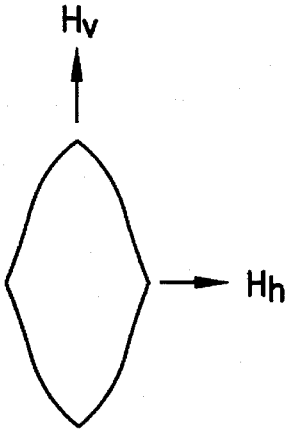
FIG. 3 is a diagram showing an aperture configuration according to a third embodiment of the present invention.

FIGS. 2 and 3 illustrate second and third embodiments of the present invention, each of which has an aperture configuration symmetric with respect to the above-mentioned diagonals but with concave or convex sides. By this, variations in the beam width with the polarized waves used for excitation can exceedingly be reduced in the horizontal direction in case of the concave side configuration and in the vertical direction in case of the convex side configuration.

Figure 4:
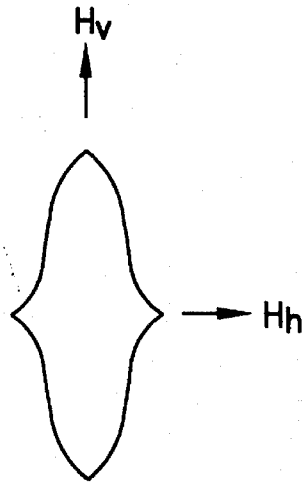
FIG. 4 is a diagram showing an aperture configuration according to the present invention.

This suggests that such an aperture configuration as depicted in an embodiment of FIG. 4 could suppress the variation in the shape of the elliptic beam more effectively than the aperture configuration of the first embodiment. In this embodiment, the respective arms of the diamond aperture are modified in such a manner as to decrease the angles of the two wide-angle corners and increase the angles of the other two narrow-angle corners.

Figure 5:
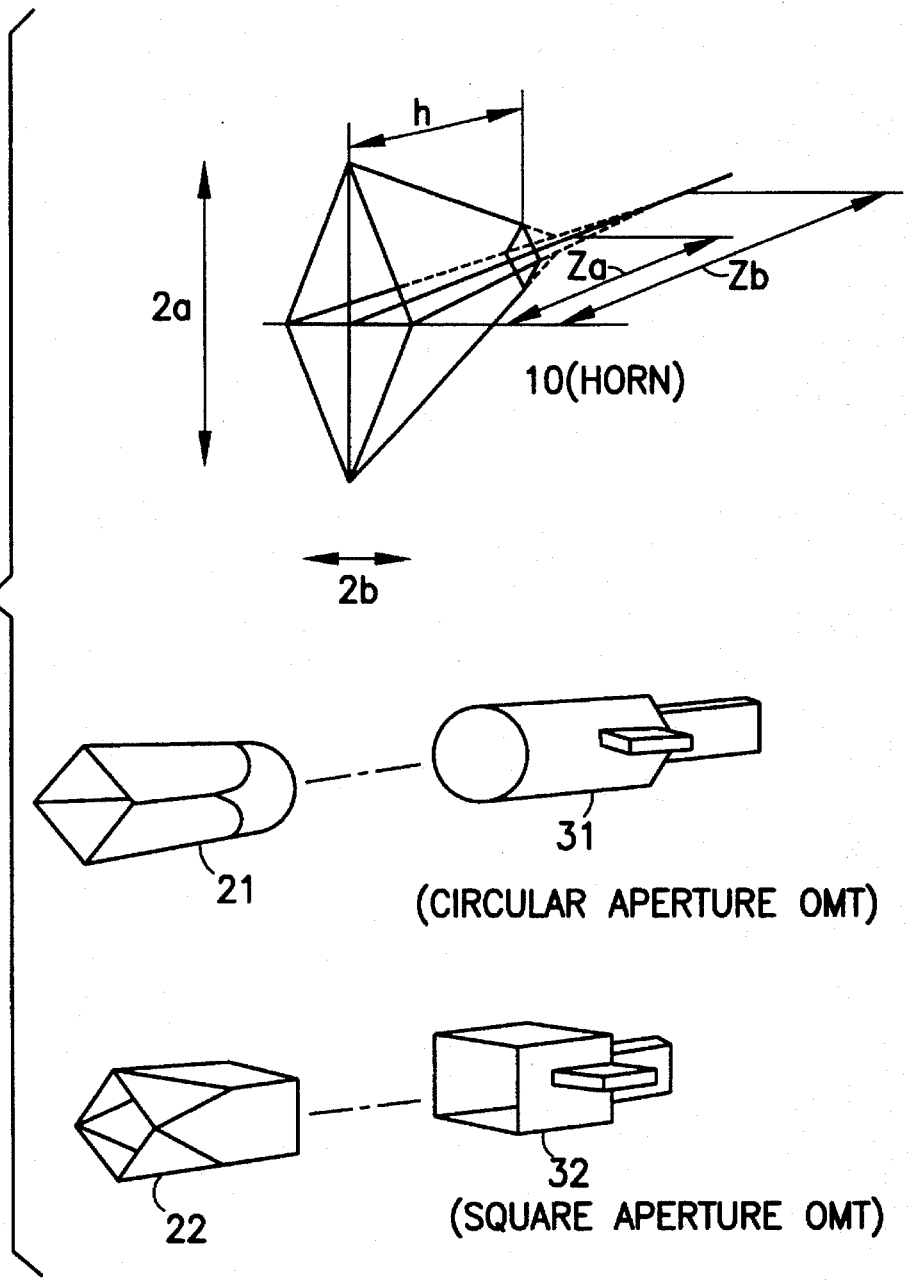
FIG. 5 is a perspective view showing a horn and a configuration convertor in a fifth embodiment of the present invention.

FIG. 5 illustrates a fifth embodiment of the present invention. According to this embodiment, in a case where the aforementioned antenna unit forms a horn antenna, the height Zb of a vertex corresponding to a shorter diagonal 2*b* of the aperture of a horn 10 is selected larger than the reciprocal proportion to the height Za of a vertex corresponding to the longer diagonal 2*a*, that is, $Zb \geqq (a/b)Za$, so as to facilitate mechanical coupling between the horn and a circular aperture OMT 31 or square aperture OMT 32 for feeding use.

Figures 6, 7:
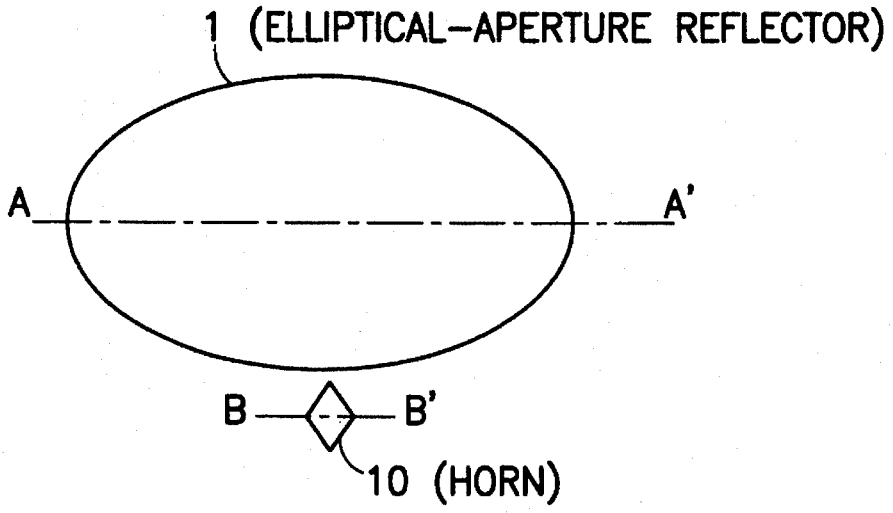
FIG. 7 PRIOR ART
FIG. 6 is a schematic diagram showing an elliptical reflector and a horn in a sixth embodiment of the present invention.
FIG. 7 is a diagram showing the relationships among the aperture configuration, the polarization for excitation use and the radiation pattern in conventional antennas.
Figure 8:
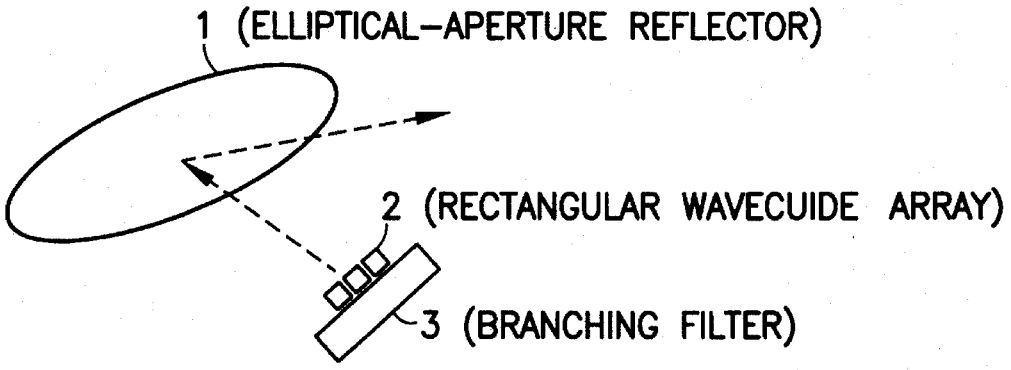
FIG. 8 PRIOR ART
FIG. 8 is a schematic diagram showing an example of a conventional antenna which employs an elliptical horn aperture for efficiently producing an elliptic beam and a feeding system for radiating the elliptic beam.
Figure 9:
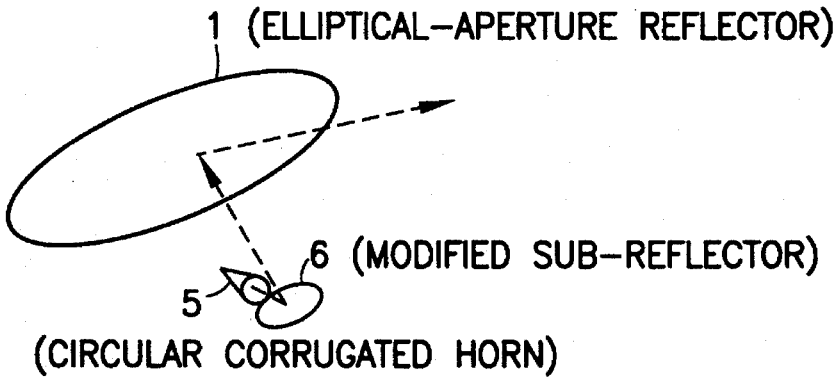
FIG. 9 PRIOR ART
FIG. 9 is a schematic diagram showing another example of the conventional antenna which employs the elliptical horn aperture for efficiently producing an elliptic beam and a feeding system for radiating the elliptic beam.
Figure 10:
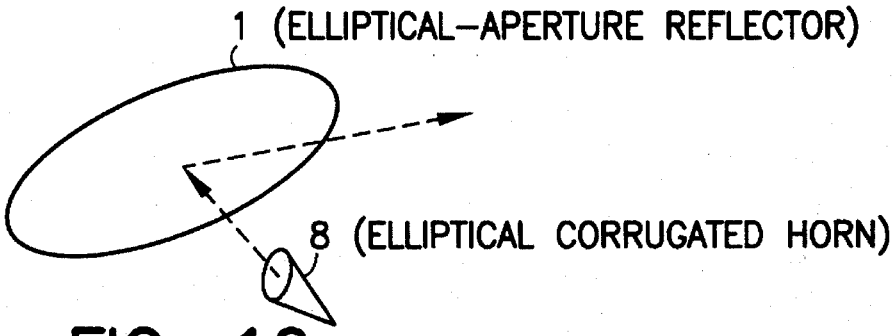
FIG. 10 PRIOR ART
FIG. 10 is a schematic diagram showing still another example of the conventional antenna which employs the elliptical horn aperture for efficiently producing an elliptic beam and a feeding system for radiating the elliptic beam.

FIG. 6 illustrates a sixth embodiment of the present invention. In antenna unit of the type which is formed by a single-surface, elliptical reflector 1 and the feeding system (the horn 10) of the first or second embodiment for exciting, the shorter diagonal B–B' of the horn 10 is placed substantially in parallel to the longer axis A–A' of the elliptical reflector. By using two or more feeding system, a difference pattern could be generated.

While in the above the embodiments have been described to use the linearly polarized waves for excitation, the circularly polarized wave could also efficiently provide the elliptic beam, since the circularly polarized wave is produced by synthesizing or combining two orthogonal linearly polarized waves at the diamond aperture of the feeding system.

It is also one of the features of the present invention that side lobes in the directions of major and minor axes of the elliptic beam become low regardless of the kind of polarized wave for excitation as in a case of a diagonal horn antenna.

Incidentally, the inner portions of four vertexes of the diagonals are all in the form of a concave wedge, but the tip of the wedge portion may be rounded to some extent; this will not appreciably lessen the essential effect of the invention.

As described above in detail, the present invention permits easy and inexpensive design and manufacture of antenna units which ensures the formation of elliptic patterns of about the same size regardless of which of the vertically and horizontally polarized waves is used for excitation. Thus, the present invention can be applied to a variety of radar antenna and small earth station antennas for satellite communication user stations.

What I claim is:

1. An elliptic beam horn antenna, comprising:

A horn antenna or waveguide structure for radiating out radio waves into space and having an essentially diamond-shaped aperture configuration, two diagonals of said diamond-shaped aperture configuration comprising a longer diagonal and a shorter diagonal; and a feeding system for electro-magnetically coupling to said horn antenna or waveguide structure so that one or both of two diagonal directions of the diamond-shaped aperture coincide with the electric field vector of the radio waves.

2. An elliptic beam horn antenna according to claim 1, in which respective sides of said diamond-shaped aperture coincide with the electric field vector of the radio waves.

3. An elliptic beam horn antenna according to claim 2, in which the heights of the vertices of a horn of said horn antenna or waveguide structure relative to each other are essentially in inverse proportion to the length of said diagonals.

4. An antenna according to claims 1 or 2, further comprising an elliptical reflector having at least one reflecting surface, the direction of the longer diagonal being disposed to cross the longer axis of said elliptical reflector substantially at right angles thereto.

5. An elliptic beam horn antenna, comprising:

a horn antenna or waveguide structure for radiating out radio waves into space and having an essentially diamond-shaped aperture configuration, two diagonals of said diamond-shaped aperture configuration comprising a longer diagonal and a shorter diagonal, respective sides of said diamond-shaped aperture being modified while being held symmetrical with respect to said diagonals, the heights of the vertices of a horn of said horn antenna or waveguide structure relative to each other being essentially in inverse proportion to the lengths of said diagonals; and a feeding system for electro-magnetically coupling to said horn antenna or waveguide structure so that one or both of two diagonal directions of the diamond-shaped aperture coincide with the electric field vector of the radio waves.

6. An antenna according to claim 5, further comprising, an elliptical reflector having at least one reflecting surface, the direction of the longer diagonal being disposed to cross the longer axis of said elliptical reflector substantially at right angles thereto.

* * * * *